US006679958B1

(12) United States Patent
Tundal et al.

(10) Patent No.: US 6,679,958 B1
(45) **Date of Patent: *Jan. 20, 2004**

(54) PROCESS OF AGING AN ALUMINUM ALLOY CONTAINING MAGNESIUM AND SILICON

(75) Inventors: Ulf Tundal, Sunndalsora (NO); Reiso Oddvin, Sunndalsora (NO)

(73) Assignee: Norsk Hydro, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/913,083

(22) PCT Filed: Feb. 12, 1999

(86) PCT No.: PCT/EP99/00940

§ 371 (c)(1),
(2), (4) Date: Jun. 5, 2002

(87) PCT Pub. No.: WO00/47793

PCT Pub. Date: Aug. 17, 2000

(51) Int. Cl.[7] ..... C22F 1/05
(52) U.S. Cl. ..... 148/690; 148/694; 148/702
(58) Field of Search ..... 148/694, 690, 148/702; C22F 1/05

(56) References Cited

U.S. PATENT DOCUMENTS 6,440,359 B1 * 8/2002 Parson et al. ..... 420/544

FOREIGN PATENT DOCUMENTS

WO WO 9506759 A1 * 3/1995 ..... C22C/21/02

* cited by examiner

*Primary Examiner*—George Wyszomierski
*Assistant Examiner*—Janelle Combs Morillo
(74) *Attorney, Agent, or Firm*—Hartman & Hartman, P.C; Gary M. Hartman; Domenica N. S. Hartman

(57) ABSTRACT

An ageing process capable of producing an aluminum alloy with better mechanical properties than possible with traditional ageing procedures. The ageing process employs a dual rate heating technique that comprises a first stage in which the aluminum alloy is heated at a first heating rate to a temperature between 100 and 170° C. and a second stage in which the aluminum alloy is heated at a second heating rate to a hold temperature of 160 to 220° C. The first heating rate is at least 100° C./hour and the second heating rate is 5 to 50° C./hour. The entire ageing process is performed in a time of 3 to 24 hours.

14 Claims, 1 Drawing Sheet

PROCESS OF AGING AN ALUMINUM ALLOY CONTAINING MAGNESIUM AND SILICON

CROSS REFERENCE TO RELATED APPLICATIONS

This application claims the benefit of International Application No. PCT/EO99/00940, filed Feb. 12, 1999.

BACKGROUND OF THE INVENTION

(1) FIELD OF THE INVENTION

The invention relates to a heat treatable AL—Mg—Si aluminium alloy which after shaping has been submitted to an ageing process, which includes a first stage in which the extrusion is heated with a heating rate above 30° C./hour to a temperature between 100–170° C., a second stage in which the extrusion is heated with a heating rate between 5 and 50° C./hour to the final hold temperature between 160 and 220° C. and in that the total ageing cycle is performed in a time between 3 and 24 hours.

(2) DESCRIPTION OF THE RELATED ART

A process for ageing aluminum alloys containing magnesium and silicon (Al—Mg—Si) is described in WO 95.06769. According to this publication the ageing is performed at a temperature between 150 and 200° C., and the rate of heating is between 10–100° C./hour preferably 10–70° C./ hour. As an alternative to this, a two-step heating schedule is proposed, wherein a hold temperature in the range of 80–140° C. is suggested in order to obtain an overall heating rate within the above specified range.

BRIEF SUMMERY OF THE INVENTION

The present invention provides an ageing process capable of producing an aluminum alloy which has better mechanical properties than possible with traditional ageing procedures and shorter total ageing times than with the ageing practise described in WO 95.06759. More particularly, the ageing process of this invention employs a dual rate heating technique that comprises a first stage in which the aluminum alloy is heated at a first heating rate to a temperature between 100 and 170° C. and a second stage in which the aluminum alloy is heated at a second heating rate to a hold temperature of 160 to 220° C. The first heating rate is at least 100° C./hour and the second heating rate is 5 to 50° C./hour. The entire ageing process is performed in a time of 3 to 24 hours. With the proposed dual rate ageing procedure of this invention, the strength of the alloy can be maximized using a minimum total ageing time.

Figure 1:
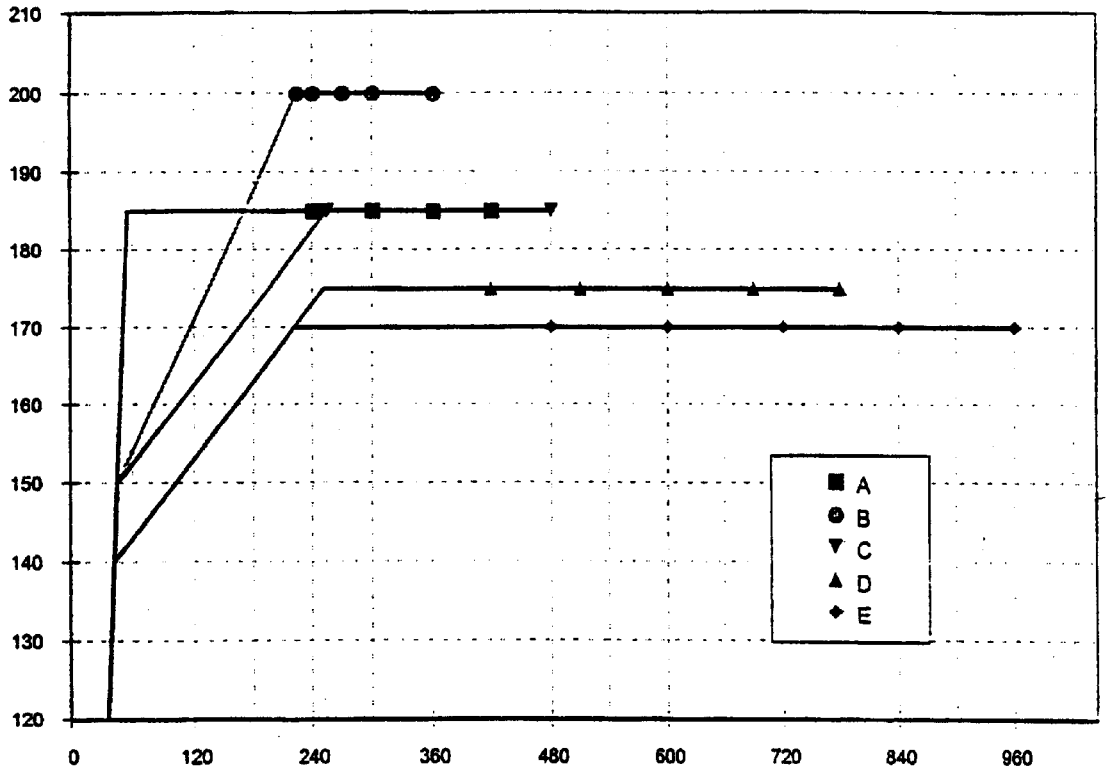
FIG. 1 is a graph showing five different ageing cycles evaluated with three different Al—Mg—Si alloys.

The positive effect on the mechanical strength of the dual rate ageing procedure can be explained by the fact that a prolonged time at low temperature generally enhances the formation of a higher density of precipitates of Mg—Si. If the entire ageing operation is performed at such temperature, the total ageing time will be beyond practical limits and the throughput in the ageing ovens will be too low. By a slow increase of the temperature to the final ageing temperature, the high number of precipitates nucleated at the low temperature will continue to grow. The result will be a high number of precipitates and mechanical strength values associated with low temperature ageing but with a considerably shorter total ageing time.

A two-step ageing will also give improvements in the mechanical strength, but with a fast heating from the first hold temperature to the second hold temperature there is substantial chance of reversion of the smallest precipitates, with a lower number of hardening precipitates and thus a lower mechanical strength as a result. Another benefit of the dual rate ageing procedure as compared to normal ageing and also two step ageing, is that a slow heating rate will ensure a better temperature distribution in the load. The temperature history of the extrusions in the load will be almost independent of the size of the load, the packing density and the wall thickness' of the extrusions. The result will be more consistent mechanical properties than with other types of ageing procedures.

As compared to the ageing procedure described in WO 95.06759 where the slow heating rate is started from the room temperature, the dual rate ageing procedure will reduce the total ageing time by applying a fast heating rate from room temperature to temperatures between 100 and 170° C. The resulting strength will be almost equally good when the slow heating is started at an intermediate temperature as if the slow heating is started at room temperature.

The invention also relates to an Al—Mg—Si alloy in which after the first ageing step a hold of 1 to 3 hours is applied at a temperature between 130 and 160° C.

In a preferred embodiment of the invention the final ageing temperature is at least 165° C. and more preferably the ageing temperature is at most 205° C. When using these preferred temperatures it has been found that the mechanical strength is maximised while the total ageing time remains within reasonable limits.

In order to reduce the total ageing time in the dual rate ageing operation it is preferred to perform the first heating stage at the highest possible heating rate available, while as a rule is dependent upon the equipment available. Therefore, it is preferred to use in the first heating stage a heating rate of at least 100° C./hour.

In the second heating stage the heating rate must be optimised in view of the total efficiency in time and the ultimate quality of the alloy. For that reason the second heating rate is preferably at least 7° C./hour and at most 30° C./hour. At lower heating rates than 7° C./hour the total ageing time will be long with a low throughput in the ageing ovens as a result, and at higher heating rates than 30° C./hour the mechanical properties will be lower than ideal.

Preferably, the first heating stage will end up at 130–160° C. and at these temperatures there is a sufficient precipitation of the $Mg_5Si_8$ phase to obtain a high mechanical strength of the alloy. A lower end temperature of the first stage will generally lead to an increased total ageing time without giving significant additional strength. Preferably the total ageing time is at most 12 hours.

Example 1

Three different alloys with the composition given in Table 1 were cast as ø95 mm billets with standard casting conditions for AA6060 alloys. The billets were homogenised with a heating rate of approximately 250° C./hour, the holding period was 2 hours and 15 minutes at 575° C., and the cooling rate after homogenisation was approximately 350° C./hour. The logs were finally cut into 200 mm long billets.

TABLE 1

| Alloy | Si | Mg | Fe |
|---|---|---|---|
| 1 | 0.37 | 0.36 | 0.19 |
| 2 | 0.41 | 0.47 | 0.19 |
| 3 | 0.51 | 0.36 | 0.19 |

The extrusion trial was performed in an 800 ton press equipped with a ø100 mm container, and an induction furnace to heat the billets before extrusion.

In order to get good measurements of the mechanical properties of the profiles, a trial was run with a die which gave a 2*25 $mm^2$ bar. The billets were preheated to approximately 500° C. before extrusion. After extrusion the profiles were cooled in still air giving a cooling time of approximately 2 min down to temperatures below 250° C. After extrusion the profiles were stretched 0.5%. The storage time at room temperature were controlled to 4 hours before ageing. Mechanical properties were obtained by means of tensile testing.

The mechanical properties of the different alloy aged at different ageing cycles are shown in tables 2–4.

As an explanation to these tables, reference is made to FIG. 1 in which different ageing cycles are shown graphically and identified by a letter. In FIG. 1 there is shown the total ageing time on the x-axis, and the temperature used is along the y-axis.

Furthermore the different columns have the following meaning:

Total time=total time for the ageing cycle.

Rm=ultimate tensile strength;

$R_{PO2}$=yield strength;

AB=elongation to fracture;

Au=uniform elongation.

All these data are the average of two parallel samples of the extruded profile.

TABLE 2

Alloy 1 – 0.36Mg + 0.37Si

| | Total Time [hrs] | Rm | RpO2 | AB | Au |
|---|---|---|---|---|---|
| A | 3 | 150.1 | 105.7 | 13.4 | 7.5 |
| A | 4 | 164.4 | 126.1 | 13.6 | 6.6 |
| A | 5 | 174.5 | 139.2 | 12.9 | 6.1 |
| A | 6 | 183.1 | 154.4 | 12.4 | 4.9 |
| A | 7 | 185.4 | 157.8 | 12.0 | 5.4 |
| B | 3.5 | 175.0 | 135.0 | 12.3 | 6.3 |
| B | 4 | 181.7 | 146.6 | 12.1 | 6.0 |
| B | 4.5 | 190.7 | 158.9 | 11.7 | 5.5 |
| B | 5 | 195.5 | 169.9 | 12.5 | 5.2 |
| B | 6 | 202.0 | 175.7 | 12.3 | 5.4 |
| C | 4 | 161.3 | 114.1 | 14.0 | 7.2 |
| C | 5 | 185.7 | 145.9 | 12.1 | 6.1 |
| C | 6 | 197.4 | 167.6 | 11.6 | 5.9 |
| C | 7 | 203.9 | 176.0 | 12.6 | 6.0 |
| C | 8 | 205.3 | 178.9 | 12.0 | 5.5 |
| D | 7 | 195.1 | 151.2 | 12.6 | 6.6 |
| D | 8.5 | 208.9 | 180.4 | 12.5 | 5.9 |
| D | 10 | 210.4 | 181.1 | 12.8 | 6.3 |
| D | 11.5 | 215.2 | 187.4 | 13.7 | 6.1 |
| D | 13 | 219.4 | 189.3 | 12.4 | 5.8 |
| E | 8 | 195.6 | 158.0 | 12.9 | 6.7 |
| E | 10 | 205.9 | 176.2 | 13.1 | 6.0 |
| E | 12 | 214.8 | 185.3 | 12.1 | 5.8 |
| E | 14 | 216.9 | 192.5 | 12.3 | 5.4 |
| E | 16 | 221.5 | 196.9 | 12.1 | 5.4 |

TABLE 3

Alloy .2 – 0.47Mg + 0.41Si

| | Total Time [hrs] | Rm | RpO2 | AB | Au |
|---|---|---|---|---|---|
| A | 3 | 189.1 | 144.5 | 13.7 | 7.5 |
| A | 4 | 205.6 | 170.5 | 13.2 | 6.6 |
| A | 5 | 212.0 | 182.4 | 13.0 | 5.8 |
| A | 6 | 216.0 | 187.0 | 12.3 | 5.6 |
| A | 7 | 216.4 | 188.8 | 11.9 | 5.5 |
| B | 3.5 | 208.2 | 172.3 | 12.8 | 6.7 |
| B | 4 | 213.0 | 175.5 | 12.1 | 6.3 |
| B | 4.5 | 219.6 | 190.5 | 12.0 | 6.0 |
| B | 5 | 225.5 | 199.4 | 11.9 | 5.6 |
| B | 6 | 225.8 | 202.2 | 11.9 | 5.8 |
| C | 4 | 195.3 | 148.7 | 14.1 | 8.1 |
| C | 5 | 214.1 | 178.6 | 13.8 | 6.8 |
| C | 6 | 227.3 | 198.7 | 13.2 | 6.3 |
| C | 7 | 229.4 | 203.7 | 12.3 | 6.6 |
| G | 8 | 228.2 | 200.7 | 12.1 | 6.1 |
| D | 7 | 222.9 | 185.0 | 12.6 | 7.8 |
| D | 8.5 | 230.7 | 194.0 | 13.0 | 6.8 |
| D | 10 | 236.6 | 205.7 | 13.0 | 6.6 |
| D | 11.5 | 236.7 | 208.0 | 12.4 | 6.6 |
| D | 13 | 239.6 | 207.1 | 11.5 | 5.7 |
| E | 8 | 229.4 | 196.8 | 12.7 | 6.4 |
| E | 10 | 233.5 | 199.5 | 13.0 | 7.1 |
| E | 12 | 237.0 | 206.9 | 12.3 | 6.7 |
| E | 14 | 236.0 | 206.5 | 12.0 | 6.2 |
| E | 16 | 240.3 | 214.4 | 12.4 | 6.8 |

TABLE 4

Alloy 3 – 0.36Mg + 0.51Si

| | Total Time [hrs] | Rm | RpO2 | AB | Au |
|---|---|---|---|---|---|
| A | 3 | 200.1 | 161.8 | 13.0 | 7.0 |
| A | 4 | 212.5 | 178.5 | 12.6 | 6.2 |
| A | 5 | 221.9 | 195.6 | 12.6 | 5.7 |
| A | 6 | 222.5 | 195.7 | 12.0 | 6.0 |
| A | 7 | 224.6 | 196.0 | 12.4 | 5.9 |
| B | 3.5 | 222.2 | 186.9 | 12.6 | 6.6 |
| B | 4 | 224.5 | 188.8 | 12.1 | 6.1 |
| B | 4.5 | 230.9 | 203.4 | 12.2 | 6.6 |
| B | 5 | 231.1 | 211.7 | 11.9 | 6.6 |
| B | 6 | 232.3 | 208.8 | 11.4 | 5.6 |
| C | 4 | 215.3 | 168.5 | 14.5 | 8.3 |
| C | 5 | 228.9 | 194.9 | 13.6 | 7.5 |
| C | 6 | 234.1 | 206.4 | 12.6 | 7.1 |
| C | 7 | 239.4 | 213.3 | 11.9 | 6.4 |
| C | 8 | 239.1 | 212.5 | 11.9 | 5.9 |
| D | 7 | 236.7 | 195.9 | 13.1 | 7.9 |
| D | 8.5 | 244.4 | 209.6 | 12.2 | 7.0 |
| D | 10 | 247.1 | 220.4 | 11.8 | 6.7 |
| D | 11.5 | 246.8 | 217.8 | 12.1 | 7.2 |
| D | 13 | 249.4 | 223.7 | 11.4 | 6.6 |
| E | 8 | 243.0 | 207.7 | 12.8 | 7.6 |
| E | 10 | 244.8 | 215.3 | 12.4 | 7.4 |
| E | 12 | 247.6 | 219.6 | 12.0 | 6.9 |
| E | 14 | 249.3 | 222.5 | 12.5 | 7.1 |
| E | 16 | 250.1 | 220.8 | 11.5 | 7.0 |

Based upon these results the following comments apply.

The ultimate tensile strength (UTS) of alloy no. 1 is slightly above 180 MPa after the A-cycle and 6 hours total time. The UTS values are 195 MPa after a 5 hours B-cycle, and 204 MPa after a 7 hours C-cycle. With the D-cycle the UTS values reaches approximately 210 MPa after 10 hours and 219 MPa after 13 hours.

With the A-cycle alloy no. 2 show a UTS value of approximately 216 MPa after 6 hours total time. With the B-cycle and 5 hours total time the UTS value is 225 MPa. With the D-cycle and 10 hours total time the UTS value has increased to 236 MPa.

Alloy no. 3 has an UTS value of 222 MPa after the A-cycle and 6 hours total time. With the B-cycle of 5 hours total time the UTS value is 231 MPa. With the C-cycle of 7 hours total time the UTS value is 240 MPa. With the D-cycle of 9 hours the UTS value is 245 MPa. With the E-cycle UTS values up to 250 MPa can be obtained The total elongation values seem to be almost independent of the ageing cycle. At peak strength the total elongation values, AB, are around 12%, even though the strength values are higher for the dual rate ageing cycles.

What is claimed is:

1. A process for ageing a heat treatable Al—Mg—Si aluminum alloy after extruding and then cooling the aluminum alloy, the process comprising a first stage in which the aluminum alloy is heated at a first heating rate to a temperature between 100 and 170° C. and a second stage in which the aluminum alloy is heated at a second heating rate to a hold temperature of 160 to 220° C., the first heating rate being at least 100° C./hour and the second heating rate being 5 to 50° C./hour, the process being performed in a time of 3 to 24 hours.

2. A process according to claim 1, wherein after the first stage the aluminum alloy is held for 1 to 3 hours at a temperature of 130 to 160° C.

3. A process according to claim 1, wherein the hold temperature is at least 165° C.

4. A process according to claim 1, wherein the hold temperature is at most 205° C.

5. A process according to claim 1, wherein the second heating rate is at least 7° C./hour.

6. A process according to claim 1, wherein the second heating rate is at most 30° C./hour.

7. A process according to claim 1, wherein the aluminum alloy is heated to between 130 and 160° C. during the first stage.

8. A process according to claim 1, wherein the process is performed in a time of at least 5 hours.

9. A process according to claim 1, wherein the process is performed in a time of at most 12 hours.

10. A process according to claim 1, wherein the aluminum alloy further contains iron.

11. A process according to claim 1, wherein the aluminum alloy contains about 0.36 to about 0.47 weight percent magnesium, about 0.37 to about 0.51 weight percent silicon, and about 0.19 weight percent iron, the balance aluminum and incidental impurities.

12. A process for ageing a heat treatable Al—Mg—Si aluminum alloy after extruding and then cooling the aluminum alloy, the process comprising the steps of:

heating the aluminum alloy at a first heating rate of at least 100° C./hour to a temperature between 130 and 160° C.;

holding the aluminum alloy for 1 to 3 hours at the temperature of 130 to 160° C.; and then heating the aluminum alloy at a second heating rate of 7 to 30° C./hour to a hold temperature of 165 to 205° C.;

wherein the process is performed in a time of 5 to 12 hours.

13. A process according to claim 12, wherein the aluminum alloy further contains iron.

14. A process according to claim 12, wherein the aluminum alloy contains about 0.36 to about 0.47 weight percent magnesium, about 0.37 to about 0.51 weight percent silicon, and about 0.19 weight percent iron, the balance aluminum and incidental impurities.

* * * * *